United States Patent [19]

Tada et al.

[11] 4,395,657

[45] Jul. 26, 1983

[54] MAGNETRON UNIT WITH A MAGNETIC FIELD COMPENSATING MEANS

[75] Inventors: Isao Tada; Toshio Okamura; Akira Kousaka; Kaichiro Nakai, all of Yokohama, Japan

[73] Assignee: Tokyo Shibaura Denki Kabushiki Kaisha, Kawasaki, Japan

[21] Appl. No.: 216,677

[22] Filed: Dec. 15, 1980

[30] Foreign Application Priority Data

Dec. 21, 1979 [JP] Japan ..... 54-177559[U]

[51] Int. Cl.[3] ..... H01J 25/50

[52] U.S. Cl. ..... 315/39.71; 315/39.51; 315/39.75

[58] Field of Search ..... 315/39.51, 39.53, 39.71, 315/39.75

[56] References Cited

U.S. PATENT DOCUMENTS

| | | | |
|---|---|---|---|
| 3,372,299 | 3/1968 | Van De Goor | 315/39.71 |
| 4,027,194 | 5/1977 | Yamano et al. | 315/39.71 |
| 4,048,542 | 9/1977 | Miura | 315/39.71 |
| 4,063,129 | 12/1977 | Miura et al. | 315/39.71 |
| 4,282,459 | 8/1981 | Oguro | 315/39.71 |
| 4,338,545 | 7/1982 | Koinuma et al. | 315/39.71 |

FOREIGN PATENT DOCUMENTS

| | | | |
|---|---|---|---|
| 232394 | 8/1969 | U.S.S.R. | 315/39.71 |

*Primary Examiner*—Saxfield Chatmon, Jr.
*Attorney, Agent, or Firm*—Cushman, Darby & Cushman

[57] ABSTRACT

A magnetron unit has a magnetic flux path for magnetic flux supplied from a permanent magnet to the interaction space. A magnetic member is disposed outside the anode cylinder for providing a by-path for the magnetic flux supplied from the permanent magnet. This magnetic member is made of a magnetic compensating alloy whose magnetic permeability decreases with an increase in temperature.

7 Claims, 6 Drawing Figures

MAGNETRON UNIT WITH A MAGNETIC FIELD COMPENSATING MEANS

BACKGROUND OF THE INVENTION

The present invention relates to a magnetron unit and, more particularly, to an improvement in a magnetron unit having means for compensating the magnetic field to be applied to the interaction space inside the magnetron unit.

Generally, a magnetron unit has a pair of permanent magnet members. The temperature of the permanent magnet members is raised mainly by heat generated at the anode in the operation of the magnetron unit. With the temperature rise of the permanent magnet members, the magnetic energy of the permanent magnet members decreases. Alnico magnets and ferrite magnets, which have been widely used as the permanent magnet members of the magnetron unit, have reversible temperature coefficients of residual flux density of approximately −0.02%/°C. and −0.2%/°C. respectively. As seen from comparing these reversible temperature coefficients, the magnetic energy of a ferrite magnet depends more on temperature than that of an alnico magnet. Accordingly, in a magnetron unit with a pair of ferrite magnet members, the intensity of the axial magnetic field generated in the interaction space decreases greatly with an increase in temperature within the anode cylinder. This greatly changes the performance of the magnetron unit. A magnetron device employing the magnetron unit generally uses a leakage transformer for increasing the power source impedance to make the anode current uniform. With such a magnetron unit, when the intensity of the magnetic field inside the interaction space is reduced by the increase in temperature, the anode current may increase due to the characteristics of the magnetron unit. However, such an increase of the anode current is suppressed by the leakage transformer so that the anode current is kept substantially constant. However, the anode voltage supplied by the leakage transformer is decreased so that the electric power fed to the magnetron unit is reduced. As a result, power of the microwaves generated by the magnetron unit decreases or becomes unstable. Depending on the characteristics of the leakage transformer, the anode current which tends to increase cannot be maintained substantially constant, so that an excessive current flows to the leakage transformer and the leakage transformer becomes burned out.

SUMMARY OF THE INVENTION

Accordingly, an object of the invention is to provide an improved magnetron unit with which the intensity of the magnetic field in the interaction space is substantially constant, regardless of changes in temperature, thereby providing a magnetron unit with stabilized performance.

According to the invention, there is provided a magnetron unit comprising:

an anode cylinder provided with a number of resonant cavities therein;

a cathode disposed within the anode cylinder and along the axis of the anode cylinder, an interaction space being defined between the anode resonant cavities and the cathode;

at least one pole piece for supplying a magnetic field in the interaction space;

cover means for hermetically sealing the anode cylinder;

at least one permanent magnet member disposed outside the anode cylinder and magnetically coupled with the pole piece;

a magnetic flux path being formed in the pole piece and the interaction space; and at least one magnetic member magnetically coupled to said permanent member so as to form a magnetic flux by-path parallel to the magnetic flux path, the magnetic permeability of said magnetic member being reduced as the temperature of said magnetic member is raised by the heat generated in the anode cylinder.

According to another aspect of the present invention, there is provided:

an anode cylinder provided with a number of resonant cavities therein;

a cathode disposed within the anode cylinder and along the axis of the anode cylinder, an interaction space being defined between the anode resonant cavities and the cathode;

at least one pole piece for supplying a magnetic field in the interaction space;

cover means for hermetically sealing the anode cylinder;

at least one permanent magnet member disposed outside the anode cylinder and magnetically coupled with the pole piece; a magnetic flux path being formed in the permanent magnet member, the pole piece and the interaction space; and an additional permanent magnet for generating magnetic flux in the interaction space in the opposite direction to the magnetic flux supplied from said permanent magnet member, the magnetomotive force of said additional permanent magnet being reduced as the temperature of said additional permanent magnet is raised by heat generated in the anode cylinder.

DETAILED DESCRIPTION OF THE PREFERRED EMBODIMENTS

Figure 1:
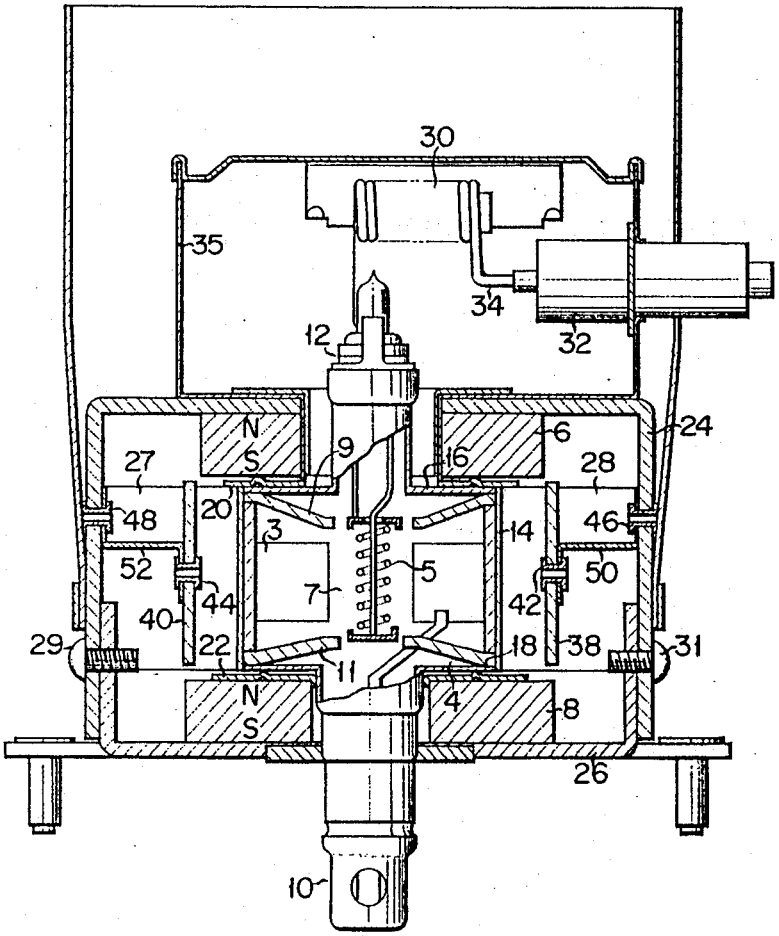
FIG. 1 is a longitudinal sectional view illustrating a magnetron unit according one embodiment of the present invention.
Figure 2:
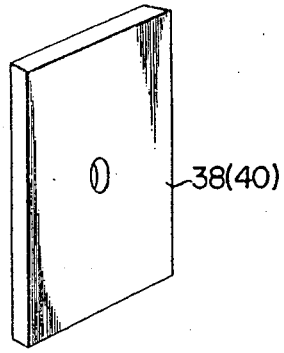
FIG. 2 is a perspective view illustrating the magnetic compensating plate assembled in the magnetron unit shown in FIG. 1.

In FIG. 1, one embodiment of the magnetron unit of the present invention is shown. As is well known, the magnetron unit shown in FIG. 1 is of the external magnet type and thus includes a pair of ring-shaped permanent magnets 6, 8 of ferrite outside the magnetron body 4. Through each hole of the pair of the permanent magnets 6, 8 are inserted an antenna section or microwave output section 10 extending from a magnetron body 4 and a cathode stem section 12 for supplying electric power to the magnetron body 4. Both open ends of an anode cylinder 14 of the magnetron body 4 are hermetically sealed by cover plates 16, 18 to which are coupled the microwave output section 10 and the cathode stem section 12. As is disclosed by the U.S. patent application Ser. No. 123,949 filed on Feb. 25, 1980, now U.S. Pat. No. 4,338,545, by Koinuma et al with the same object as the present invention, in the anode cylinder 14 are housed a number of radially arranged vanes 3 forming a number of resonant cavities, a cathode 5 disposed on the central axis of the anode cylinder 14, and a pair of pole pieces 9, 11 magnetically coupled to the permanent magnets 6, 8 respectively for guiding a magnetic flux in an interaction space 7 formed between the cathode and the anode cylinder. Magnetic plates 20, 22 for concentrating the magnetic flux from the permanent magnets 6, 8 for directing it to the pole pieces inside the anode cylinder 14 are disposed between the outer sides of the cover plates 16, 18 and the permanent magnets 6, 8. This pair of permanent magnets 6, 8 are magnetically coupled by a pair of frame-shaped yokes 24, 26. The yokes 24, 26 are mechanically connected by screw members 29, 31 as shown in the figure, and this pair of frame-shaped yokes 24, 26 hold the anode cylinder 14 and the pair of permanent magnets 6, 8. A vertical radiator, that is, a radiator comprising a number of fins 27, 28 for cooling the anode cylinder, is disposed on the outer circumference of the anode cylinder 14 in such a manner that its surface is substantially parallel to the central axis of the anode cylinder 14. A filter device 34 comprising a choking coil 30 and a capacitor 32 is connected to the cathode stem section 12. The filter device 34 and the cathode stem section 12 are received inside a shielding-box 35 for preventing leakage of high frequency waves.

In the magnetron unit shown in FIG. 1, a pair of rectangular magnetic compensating plates 38, 40 made of a magnetic compensating alloy such as an Fe-Ni alloy or Monel metal are arranged between any adjacent fins 27, 28 of the vertical radiator so that their temperature may be raised by the heat emitted by the anode cylinder during the time the magnetron unit is in operation. This magnetic compensating alloy is known to be a material whose magnetic permeability is reduced as the temperature is raised within the range of room temperature to 400° C. This pair of magnetic compensating plates 38, 40 are located so that their surfaces oppose the outer surface of the anode cylinder 14 and they are symmetrical about the central axis of the anode cylinder 14 as shown in FIG. 1. Rivets 42, 44, 46 and 48 are mounted to the magnetic compensating plates 38, 40 and the yokes 24, 26, respectively. The magnetic compensating plates 38, 40 are supported by at predetermined positions and are thermally coupled to support members 50, 52 of nonmagnetic material secured by these rivets 42, 44, 46 and 48.

Since the magnetic compensating plates are arranged, as described above, on the outer circumference of the anode cylinder 14, a magnetic flux path and a magnetic flux by-path are formed parallel to each other between the pair of permanent magnets 6, 8. The magnetic flux path passes through the pole piece 9, the interaction space inside the magnetron body 4 and the pole pieces. The magnetic flux by-paths pass through the magnetic compensating plates 38 and 40 respectively. When electric power is not supplied to the magnetron unit, magnetic flux is supplied to the magnetic flux path from the permanent magnets 6, 8 so that a magnetic field sufficient to oscillate the magnetron unit is generated in the interaction space. When electric power is supplied to the magnetron unit, the magnetron unit starts oscillating and starts generating microwaves from the microwave output section 10. By the oscillation of the magnetron unit, the temperature of the magnetron unit starts rising. With this temperature rise, the temperatures of the permanent magnets 6, 8 are increased by the heat conducted from the magnetron unit. With this temperature increase, the magnetomotive force of the permanent magnets 6, 8 is degraded, and the supplied magnetic flux is reduced. Additionally, the magnetic permeability of the magnetic compensating plates 38, 40 is reduced and the magnetic flux leaked through these plates 38, 40 is also reduced. Thus, the magnetic flux supplied to the interaction space is kept substantially constant, regardless of the temperature of the permanent magnets 6, 8.

According to the embodiment shown in FIG. 1, the magnetron unit is provided with the magnetic flux path and the magnetic flux by-path and the magnetic reluctance of the by-path gradually increases with the increase in temperature. Therefore, the magnetic flux in the magnetic flux path is kept substantially constant even when the magnetomotive force of the permanent magnets 6, 8 is reduced. Accordingly, the magnetron unit is capable of oscillating with stability even when its temperature is raised.

Figure 3:
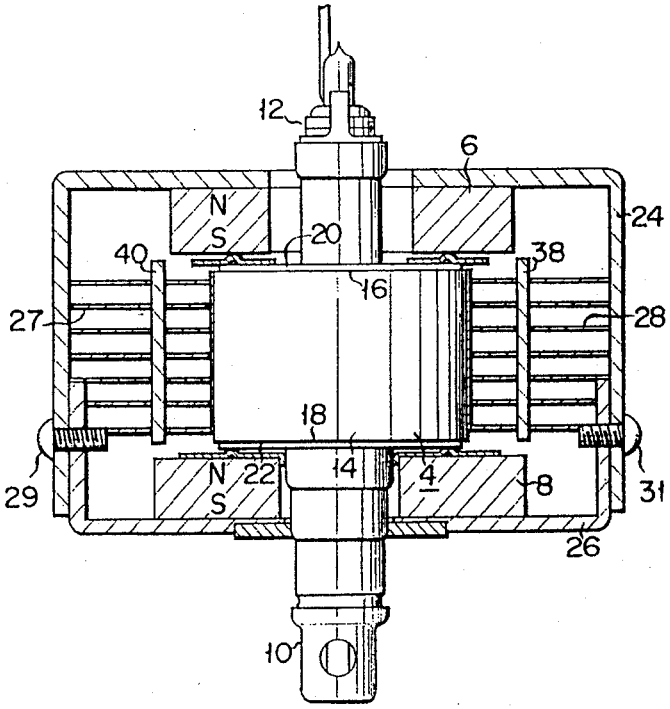
FIGS. 3 and 4 are a longitudinal sectional view and a transverse sectional view, respectively, schematically illustrating a modification of the magnetron unit shown in FIG. 1, the anode cylinder not being cut away in either figure.
Figure 4:
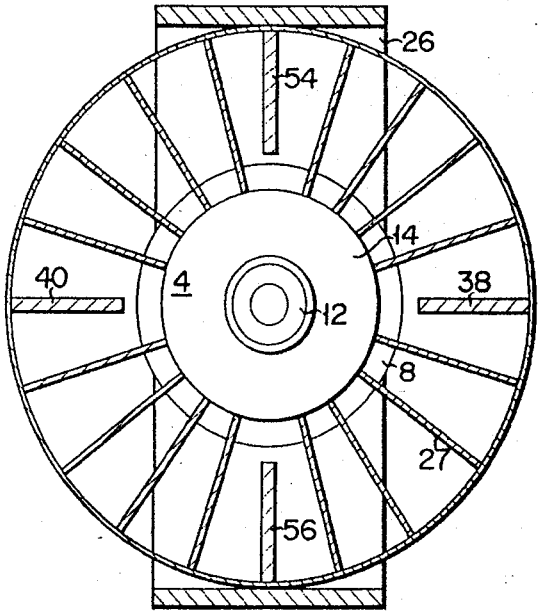

Modified embodiment of the magnetron unit shown in FIG. 1 will now be described referring to FIGS. 3 and 4. FIG. 3 shows a magnetron unit having a so-called horizontal radiator consisting of a number of anode cylinder cooling fins 27, 28 mounted on the anode cylinder 14 so as to be vertical to the central axis of the anode cylinder 14. Magnetic compensating plates 38, 40 are mounted and thermally coupled to the fins 27, 28 of the radiator as shown in FIG. 3 by means such as soldering. In the embodiment shown in FIG. 3, the magnetic compensating plates 38, 40 are opposed to the outer surface of the anode cylinder 14 so as to receive a radiant heat from the anode cylinder. However, as shown in FIG. 4, the surface of magnetic compensating plates 38, 40, 54 and 56 may be arranged in the radial direction of the anode cylinder 14. That is, the edges of the rectangular magnetic compensating plates 38, 40, 54 and 56 may be opposed to the outer surface of the anode cylinder 14.

When the magnetic compensating plates 38, 40 are arranged as shown in FIGS. 1 and 3, the surfaces of the plates 38, 40 substantially uniformly receive the heat radiated by the anode cylinder 14. When the magnetic compensating plates 38, 40 are arranged as shown in FIG. 4, the surface areas of the plates 38, 40 near the anode cylinder 14 are raised in temperature faster than the surface areas near a yoke 24 due to the heat generated by the anode cylinder 14, so that the magnetic permeability is reduced there faster. Therefore, with the arrangement shown in FIG. 4, the magnetic permeability of the magnetic compensating plates 38, 40 is locally different, and the permeability of the plates is considered to have a distribution corresponding to the temperature distribution between the anode cylinder 14 and the yoke 24. Thus, a stable operation of the magnetron unit is obtained a long time after start of its operation. As obvious from the above, the locations, orientations, surface areas, volumes and so on of the magnetic compensating plates 38, 40 differ according to the size of magnetron unit and are thus suitably selected according to the size of magnetron unit.

Figure 5:
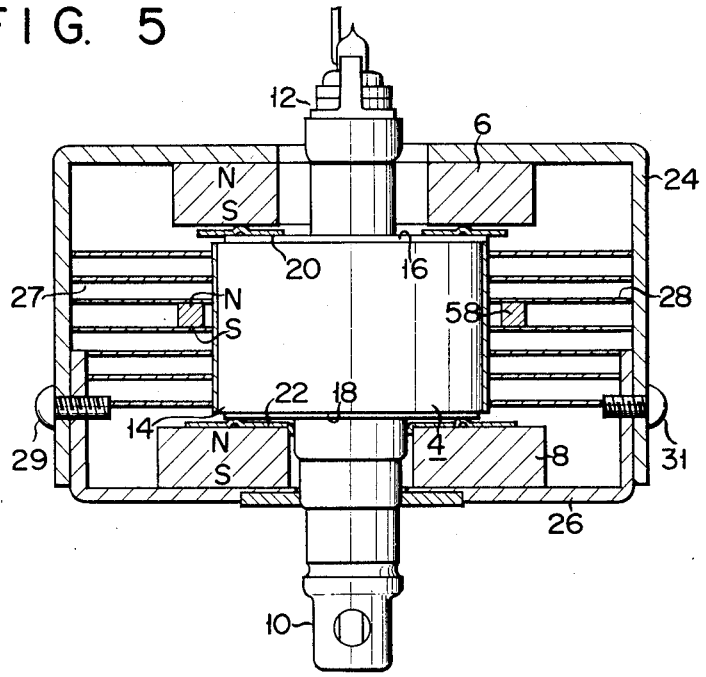
FIG. 5 is a longitudinal sectional view illustrating a magnetron unit according to another embodiment of the present invention.
Figure 6:
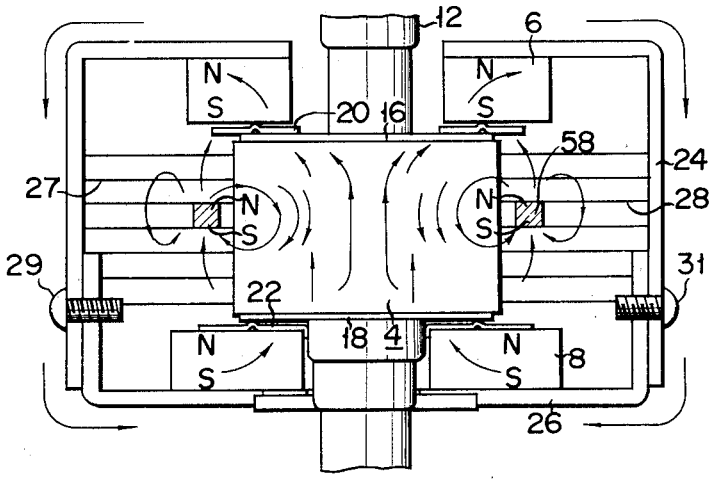
FIG. 6 is a schematic view illustrating the magnetic flux path of the magnetron unit shown in FIG. 5.

Another embodiment of the present invention will now be described referring to FIGS. 5 and 6. The same parts are designated by the same reference numerals as in FIGS. 1 to 4, so their description will be omitted. In the magnetron unit shown in FIGS. 5 and 6, instead of the magnetic compensating plates 38, 40, an auxiliary magnet 58 of ring shape surrounds the outer circumference of the anode cylinder 14. The magnet 58 is mounted and thermally coupled to the fins 27, 28 of the radiator so that the opposing surfaces of the magnet 58 and the permanent magnets 6, 8 have opposite polarities. For example, in the example shown in the figure, the magnet 58 is so located that when the lower surface of the permanent magnet 6 is a south pole, the surface of the magnet 58 opposing it is a north pole. The position, volume and so on of the magnet 58 are suitably selected according to the size of magnetron unit. The auxiliary magnet 58 preferably has a magnetomotive force which is greatly reduced when the temperature rises and is preferably made of ferrite.

When the magnetron unit according to this embodiment, in addition to the main magnetic field formed by the permanent magnets 6, 8 in the interaction space inside the anode cylinder 14, an auxiliary magnetic field for cancelling the intensity of the main magnetic field is formed by the auxiliary magnet 58. As shown in FIG. 6, a magnetic flux path is formed by the permanent magnet 6, the yokes 24, 26, the permanent magnet 8, the pole pieces and the interaction space, as shown by the arrow. Magnet flux is supplied to the south pole from the north pole of the auxiliary magnet 58 through the space around it, and part of this magnetic flux is also supplied to the interaction space. As shown in the figure, the magnetic flux supplied in the interaction space from the pair of permanent magnets 6, 8 differs in direction from the magnetic flux supplied to the space from the auxiliary magnet. Accordingly, in the interaction space, the magnetic flux of the permanent magnets is attenuated by the magnetic flux from the auxiliary magnet 58. However, the magnetomotive force of the permanent magnets 6, 8 and the auxiliary magnet 58 are so determined that the attenuated magnetic flux in the interaction space is sufficient for oscillation of the magnetron unit. When power is supplied to the magnetron unit, the magnetron unit starts oscillating and the temperature inside it starts rising. Due to this, the temperature of each of the magnets 6, 8 and 58 also starts rising, and the both magnetomotive forces begin to greatly decrease. However, since the magnetic flux supplied to the interaction space from the auxiliary magnet 58 decreases when the magnetic flux supplied to the interaction space from the magnets 6, 8 decreases, the magnetic flux in the interaction space is kept substantially constant. As a result, the magnetron unit is kept in a stable oscillating condition regardless of the increase in temperature.

What we claim is:

1. A magnetron unit comprising:

an anode cylinder having a number of resonant cavities;

a cathode disposed within the anode cylinder and extending along the axis of the anode cylinder with an interaction space defined between the resonant cavities and the cathode;

a pair of pole pieces for generating a magnetic field in the interaction space;

cover means for hermetically sealing the anode cylinder;

a pair of permanent magnet members made of ferrite, disposed outside the anode cylinder and magnetically coupled with the pole pieces, thereby defining a main magnetic flux path in the interaction space; and at least one magnetic member made of magnetic compensating alloy, disposed between the permanent magnet members and magnetically coupled with the permanent magnet members, thereby defining a magnetic flux bypath parallel to the main magnetic flux path, the magnetic permeability of the magnetic member being reduced as the magnetic member is heated by heat generated in the anode cylinder.

2. A magnetron unit according to claim 1, wherein said magnetic member is plate-shaped and is attached to the outer circumference of the anode cylinder in such a manner that its plate surface is substantially parallel to the central axis of the anode cylinder.

3. A magnetron unit according to claim 1, wherein said magnetic member is plate-shaped and its plate surface oppose the outer circumference of the anode cylinder.

4. A magnetron unit according to claim 1, wherein said magnetic member is plate-shaped and its edge opposes the outer circumference of the anode cylinder.

5. A magnetron unit comprising:

an anode cylinder provided with a number of resonant cavities therein;

a cathode disposed within the anode cylinder and along the axis of the anode cylinder, an interaction space being defined between the anode resonant cavities and the cathode;

at least one pole piece for supplying a magnetic field in the interaction space;

cover means for hermetically sealing the anode cylinder;

at least one permanent magnet member disposed outside the anode cylinder and magnetically coupled with the pole piece;

a magnetic flux path being formed in the pole piece and the interaction space; and an additional permanent magnet for generating magnetic flux in the interaction space in the opposite direction to the magnetic flux supplied from said permanent magnet member, the magnetomotive force of said additional permanent magnet being reduced as the temperature of said additional permanent magnet is raised by heat generated in the anode cylinder.

6. A magnetron unit according to claim 5, wherein said additional permanent magnet comprises a ferrite magnet.

7. A magnetron unit according to claim 5, wherein said additional permanent magnet is ring-shaped, and the anode cylinder is located inside said ring-shaped magnet.

* * * * *